US005163664A

United States Patent [19]

Calaio

[11] Patent Number: 5,163,664

[45] Date of Patent: Nov. 17, 1992

[54] ALIGNMENT TOOL FOR MACHINE VISE AND THE LIKE

[76] Inventor: Salvatore Calaio, 3179 Hostetter Rd., San Jose, Calif. 95132

[21] Appl. No.: 634,799

[22] Filed: Dec. 28, 1990

Related U.S. Application Data

[63] Continuation of Ser. No. 362,199, Jun. 6, 1989, abandoned, which is a continuation-in-part of Ser. No. 45,339, May 4, 1987, abandoned.

[51] Int. Cl.[5] ..... B25B 1/24

[52] U.S. Cl. ..... 269/271; 269/259; 269/262; 269/265; 269/900

[58] Field of Search ..... 269/259-263, 269/265, 268, 271, 99, 900; 33/536-538

[56] References Cited

U.S. PATENT DOCUMENTS 1,308,451 7/1919 Schachat ..... 269/900

3,463,478 8/1969 Hennessey ..... 269/271

4,216,950 8/1980 Mason et al. ..... 269/271

*Primary Examiner*—J. J. Swann

*Attorney, Agent, or Firm*—Niro, Scavone, Haller & Niro

[57] ABSTRACT

A tool which is adapted to orient a work piece for machining. A first embodiment of the tool is adapted to be removably mounted on the fixed jaw of a pair of relatively shiftable jaws of a machine vise. The tool has an arm pivotally mounted thereon, and the arm has a surface for supporting and orienting a work piece relative to the jaws. A curved slot in the tool for receiving a locking device carried by the arm, whereby the arm can be moved into any one of a plurality of infinitely variable positions with the aid of a protractor to support a work piece when the work piece is between the jaws. Holes formed into the arm receive a pin for supporting the work piece. Other embodiments are a tool for orienting the compound of a lathe.

17 Claims, 4 Drawing Sheets 10
12
14
16
16
17
17
18
20
21
22
23
24
25
26
28
34
40
46

ALIGNMENT TOOL FOR MACHINE VISE AND THE LIKE

This is a continuation of Ser. No. 07/362,199, filed Jun. 6, 1989, which was a continuation-in-part of Ser. No. 07/045,339, filed May 4, 1987, entitled "Alignment Tool for Machine Vise and the Like", both now abandoned.

This invention relates to improvements in the mounting of work pieces on machine vises, drill presses and lathes and, more particularly, to a tool having a swingable arm for orienting a work piece in an unlimited number of operative positions, such as between the jaws of a machine vise.

BACKGROUND OF THE INVENTION

It is often desirable in machining a work piece to mount it in a machine vise, on a drill press or on a lathe so the work piece is oriented in an unusual position. In the case of a machine vise, the vise jaws, by themselves, cannot readily orient a work piece in all possible desired positions. This has presented some problems because it is tedious and time consuming to orient a work piece manually using only the vise jaws themselves. Generally, shims, gauge blocks, a sine bar or other mechanical supports have been used to facilitate mounting a work piece in unusual orientations, However such tools lack locating means, such as pins or other stops, to assist in positioning a work piece between the jaws.

One or more attempts have been made to provide a device for orienting a work piece in the space between a pair of vise jaws. One of these attempts is disclosed in U.S. Pat. No. 3,463,479. FIG. 1 of that patent depicts a block 20 having a plurality of holes R1 and R2 arranged along curved paths. The holes are adapted to received pins as shown in FIG. 4 of the patent. The pins are used for positioning a work piece W between the jaws of a vise. Block 20 and the holes therein for receiving the pins support a workpiece in only a limited number of operative positions. Thus, the structure disclosed in this patent fails to support a work piece between the jaws of a vise in an unlimited number of operative positions.

Other disclosures include U.S. Pat. No. 4,383,682 which shows a vise with a movable jaw that includes a rotatable platform 30. The rotatable platform 30 can be set to any inclination using an indexed rotator 34 protruding through a window formed in the top surface of a front plate 50 of the movable jaws. FIG. 2 of this patent shows the rotator 34 and the platform 30 disassembled from the front plate 50.

U.S. Pat. No. 2,930,132 shows a sine bar 22 in FIG. 1 on the upper surface of which are secured a fixed back up jaw 39 and a movable pressure jaw member 51 to form a vise for holding a work piece W. U.S. Pat. No. 3,188,076 shows a jig that is substituted for the tool post normally secured to the compound of a lathe for clamping a work piece to the compound of a lathe.

The above prior art fails to show or suggest a tool for orienting a work piece in an unlimited number of operative positions between a pair of limits when the work piece is mounted between the relatively shiftable jaws of a machine vise. Because of this limitation, a need exists for a tool that effectively and conveniently supports a work piece in an unlimited number of different orientations such as between the jaws of a vise. The present invention satisfies this need.

SUMMARY OF THE INVENTION

The present invention comprises a tool which is used to orient a work piece for machining. In one embodiment, the tool is adapted to be removably mounted on the fixed jaw of a pair of relatively shiftable jaws of a machine vise. The tool has an arm pivotally mounted thereon, and the arm has a surface for at least partially supporting and orienting a work piece relative to the jaws when the tool is mounted on one of the jaws. A curved slot extends through the tool for receiving a locking device carried by the arm, whereby the arm can be moved into any one of a plurality of infinitely variable positions with the aid of a scale on the tool. In each operative position, the arm can support and orient a work piece when the work piece is clamped between the jaws and when the tool is between the jaws. If it is necessary to achieve angles of the work piece closer than 5 minutes, then the tool 1 should be mounted and adjusted on a sine bar. After proper orientation of the work piece on the arm and the closing of the jaws onto the work piece, the work piece can be machined notwithstanding its oblique or unusual orientation relative to the jaws inasmuch as the work piece will be oriented by the arm of the tool and the work piece will be firmly clamped between the jaws during the machining operation on the work piece.

After the machining operation has been completed, the work piece can be removed from between the jaws and the arm can be oriented in a new operative position by releasing the locking device thereon and moving the arm into the new position. Then, the locking device is again secured to attach the arm in the new operative position. The orientation of the work piece can be repeated as described above and the machining of the work piece in its new orientation can then commence and be completed as before.

Another embodiment of the present invention is a tool for mounting a work piece on a drill press. Still another embodiment of the invention is a tool for orienting a compound of a lathe to effect machining of a work piece by use of the compound.

The primary object of the present invention is to provide an improved tool for use with a machine vise, a drill press or a lathe wherein the tool has a pivotal arm having a surface for at least partially supporting and orienting a work piece to be machined or drilled and the arm has a locking device associated with a slot in the tool so that the arm can be releasably locked in any one of an infinite number of operative positions between the ends of the slot so as to provide fine adjustment for the location of the work piece to be machined as the work piece is held in place by the tool.

Other objects of this invention will become apparent as the following specification progresses, reference being made to the accompanying drawings for an illustration of the invention.

DETAILED DESCRIPTION OF THE EMBODIMENTS

Figure 1:
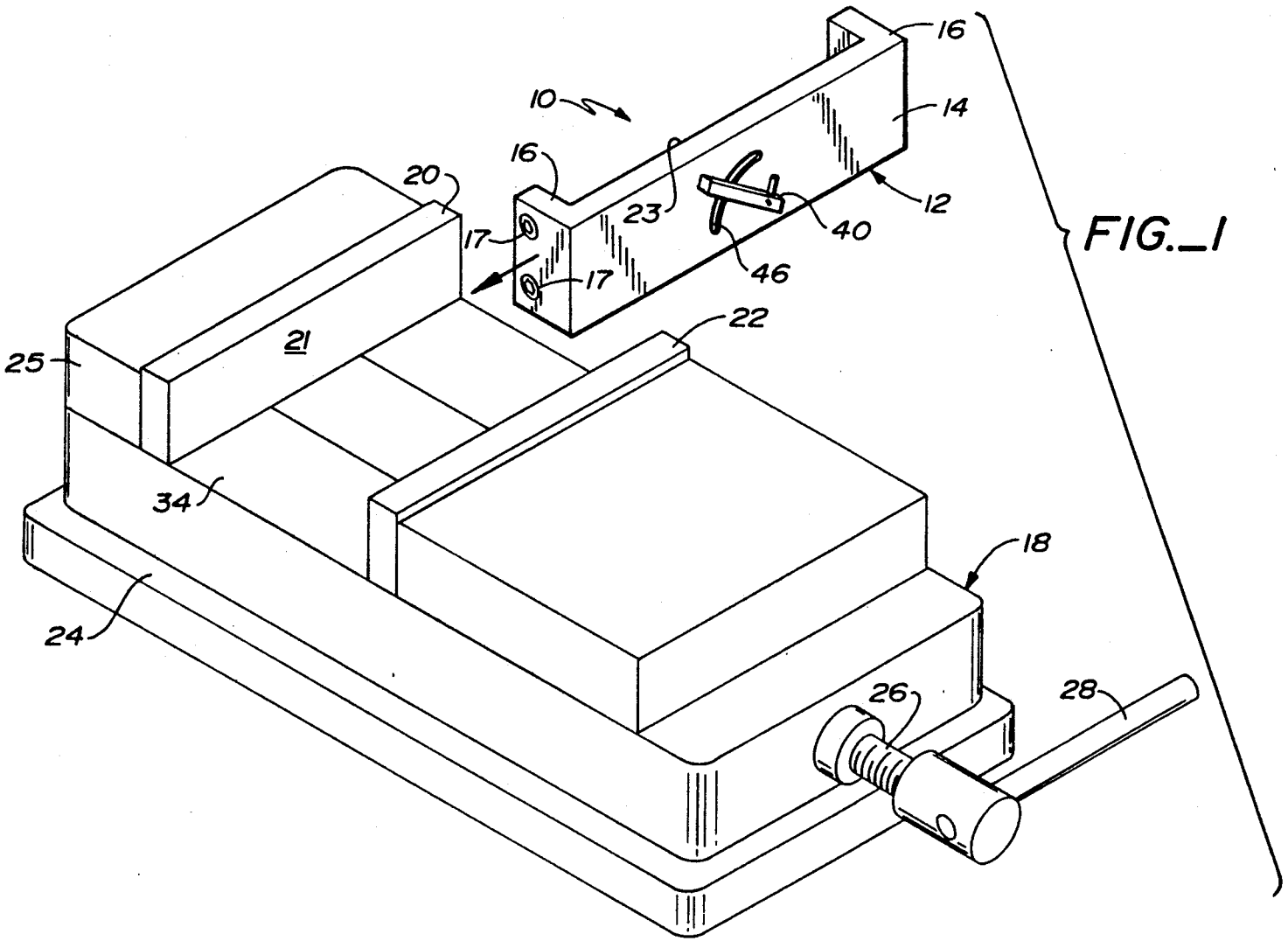
FIG. 1 is a perspective view of the alignment tool of the present invention showing the way in which it can be moved into an operative position on a machine vise having a pair of relatively shiftable jaws.

A first embodiment of the tool of the present invention is broadly denoted by the numeral 10 and includes a body 12 having a central part 14 provided with a pair of spaced, generally parallel sides 16. The central part 14 is shown integral with sides 16 but the sides could be separate from part 14 and secured thereto by machine screws. Body 12 is a flat bar formed from any suitable metallic material, such as a suitable grade of steel.

The tool 10 is adapted to be used with a machine vise 18 having a fixed jaw 20 and a movable jaw 22, the jaws being on a base 24 adapted to be placed on a support surface or the like. Base 24 has a screw 26 provided with a handle 28 for rotation of the screw. Jaw 22 is coupled with screw 26 in any suitable manner so that the jaw 22 is movable toward and away from jaw 20 along a flat surface 34 of base 24. Thus, the gap between jaws 20 and 22 can be opened or closed as desired.

Figure 2:
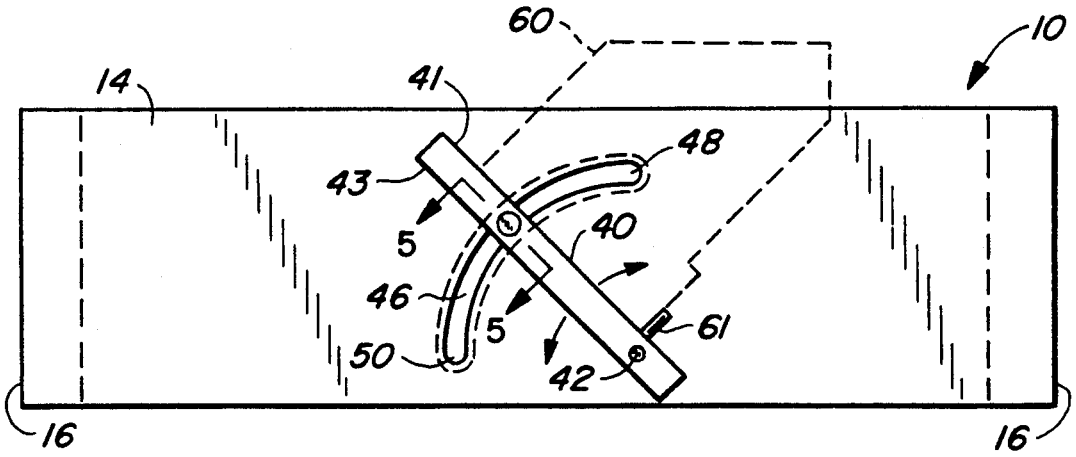
FIG. 2 is a front elevational view of the alignment tool, showing the way in which it is mounted on one of the jaws of the vise of FIG. 1.
Figure 3:
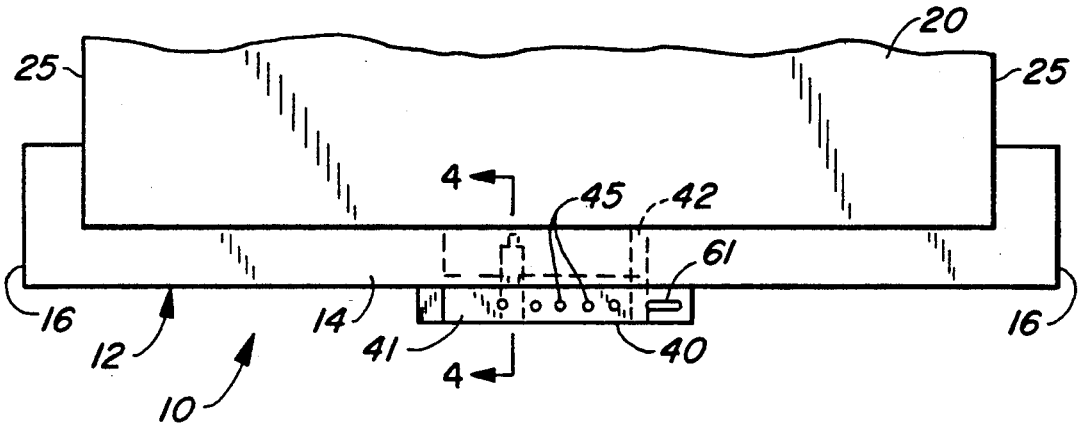
FIG. 3 is a top plan view of the tool, showing the way in which it is mounted on one of the jaws of the machine vise of FIG. 1.
Figure 4:
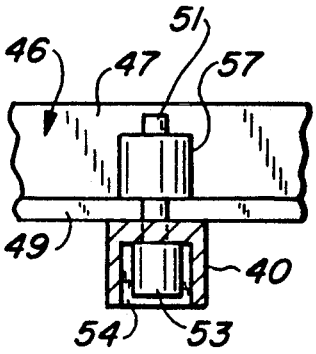
FIG. 4 is an enlarged, cross-sectional view taken along line 4—4 of FIG. 3.
Figure 5:
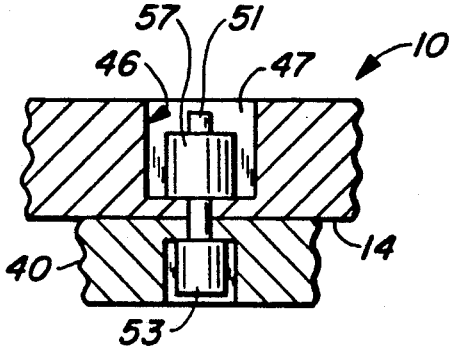
FIG. 5 is an enlarged cross-sectional view taken along line 5—5 of FIG. 2.

Tool 10 is adapted to be placed in an operative position, partly embracing fixed jaw 20. As shown in FIGS. 2 and 3, the tool 10 is mounted so that part 14 thereof is adjacent to jaw 20, the jaw 20 having a flat face 21 which is in face-to-face relationship with face 23 of part 14. The height of part 14 is slightly less than the height of jaw 20 as shown in FIG. 2; however, this difference can be minimal or nonexistent, if desired.

Sides 16 are positioned so that they extend along the side faces 25 (FIG. 3) of jaw 20. Generally, the sides 16 will be spaced apart sufficiently to allow the sides 16 to be moved easily and readily into operative positions shown in FIG. 3 along side faces 25 so that faces 21 and 23 are in abutment with each other. One or more set screws 17 on each side 16 can be used to releasably lock the tool 10 to side faces 25 of jaw 20. The tool 10, when in its operative position, has its lower flat face resting on the surface 34 of base 24, yet tool 10 does not interfere with the movement of jaw 22 toward and away from jaw 20. The tool can be inverted and used in the inverted position on jaw 20.

Tool 10 has an arm 40 which is pivotally mounted by a pin 42 on part 14 near the lower margin 44 thereof. Pin 42 is slightly off center with respect to an imaginary center line extending vertically and bisecting part 14 into two equal portions. Arm 40 can be longer as shown by the dashed line extension in FIG. 2. The arm could also be wider than that shown.

Part 14 also has a curved slot 46 therethrough, the slot having an upper end 48 and lower end 50 which are near the upper and lower margins of part 14. The arcuate length of the curved slot 46 is typically about 90° and the arc is a circular segment whose center is coincident with the central axis of pin 42 so that arm 40 is radial with respect to slot 46.

The slot 46 has a relatively wide part 47 and a relatively narrow part 49 communicating with part 47. A machine screw 51 extends through part 49 and into part 47, the screw having a head 53 in a recess 54 in arm 40. A spud or nut 57 is threaded onto screw 51 and is located in part 47 of slot 46. The nut has an eccentric hole to allow the nut to engage the inner surface defining the slot to avoid having to place a tool or socket wrench over the nut to prevent it from turning as screw 51 is rotated.

Arm 40 has a pair of flat, parallel side surfaces 41 and 43 on opposite sides of the arm 40. Arm 40 has a number of spaced holes 45 extending into side surfaces 41 and 43. The holes can be threaded to threadably receive a threaded pin 61, or the holes can be unthreaded to slidably receive an unthreaded pin 61. The holes can be blind holes, i.e., terminate at locations within arm 40, or the holes can extend through arm 40. Pin 61 has a generally cylindrical outer surface.

In use, tool 10 is placed on jaw 20 as shown in FIGS. 2 and 3 and coupled by a set screw 17 to jaw 20. With the tool 10 in place, and with a particular work piece 60 (FIG. 2) placed on the face 41 of arm 40 and supported by a pin 61 extending into a hole 45 on the arm, the arm is adjusted in angle so that the work piece will be in a particular orientation for machining purposes. Holes 45 for pin 61 are typically spaced 3/16 inch apart in arm 40.

The arm is then locked down in the desired operating position by rotating screw 51 relative to nut 57, thereby clamping arm 40 to part 14 at a desired angle. The curved slot 46 allows for infinite variations of settings between 0° and 90° or between ends 48 and 50 of slot 46 if this angle is greater or lesser than 90°. With the arm 40 properly positioned, the jaws 20 and 22 can be moved into position, clamping the work piece 60 between the jaws while the work piece is oriented by the arm 40, such as in the orientation shown in FIG. 2. After this step has been performed, the machining of the work piece can then commence and continue until completion or until the work piece is required to be oriented in a different position relative to jaws 20 and 22.

The fact that arm 40 can be rotated and held in position by nut 57 allows for infinite variations in the operative position of arm 40 within the arcuate distance or span of curved slot 46. This arcuate distance can be increased or decreased as desired so that the slot need not be limited to a 90° arcuate distance. Moreover, the length of arm 40 can be increased by removing pin 42 and replacing arm 40 with a longer arm, the arm having its own screw 51 and nut 57 for securing the arm in any one of a number of operative positions on part 14. In a particular operating position, the arm will at least partially support and orient a work piece, such as work piece 60, so that the work piece can be properly machined in a desired fashion not withstanding its oblique or unusual orientation relative to the jaws 20 and 22. Tool 10 can be inverted on jaw 20 and still be used to support and orient a work piece.

After machining, the jaws are separated and the work piece is allowed to be removed from between the jaws and from partial support and orientation by arm 40. The arm can then be moved into another operative position depending upon the desired orientation of the work piece thereafter to be machined.

When machining operations have been completed, tool 10 can be separated from jaw 20 and stored in a suitable location. This can be achieved merely by manually loosening set screw 17 and lifting the tool 10 away from the jaw since the sides 16 of the tool loosely embrace the side faces 25 of jaw 20.

Figure 7:
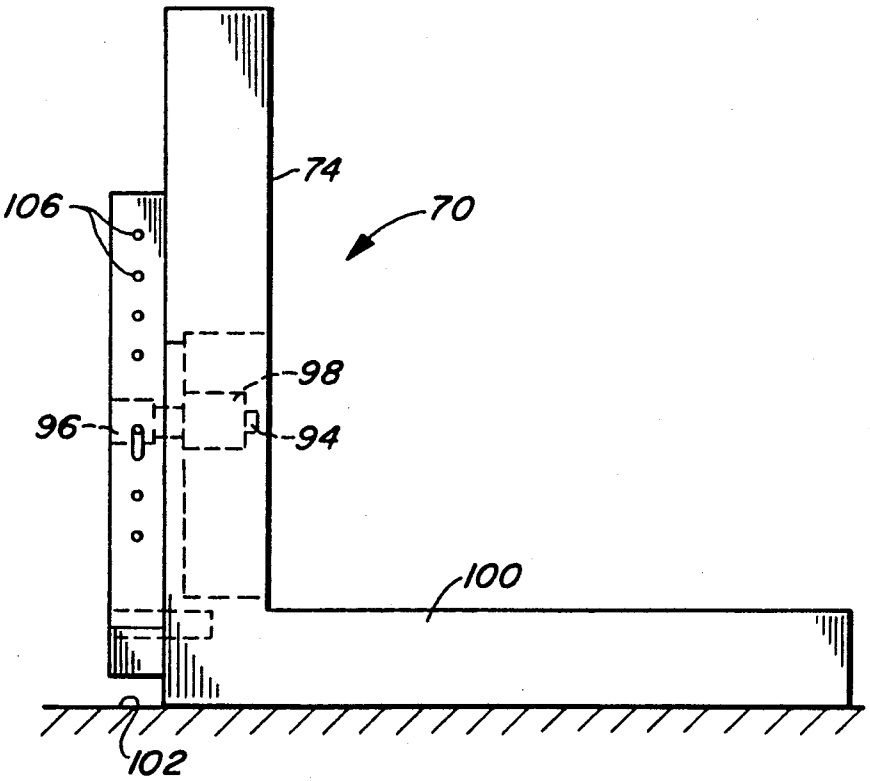
FIG. 7 is an end elevational view taken along lines 7—7 of FIG. 6.
Figure 6:
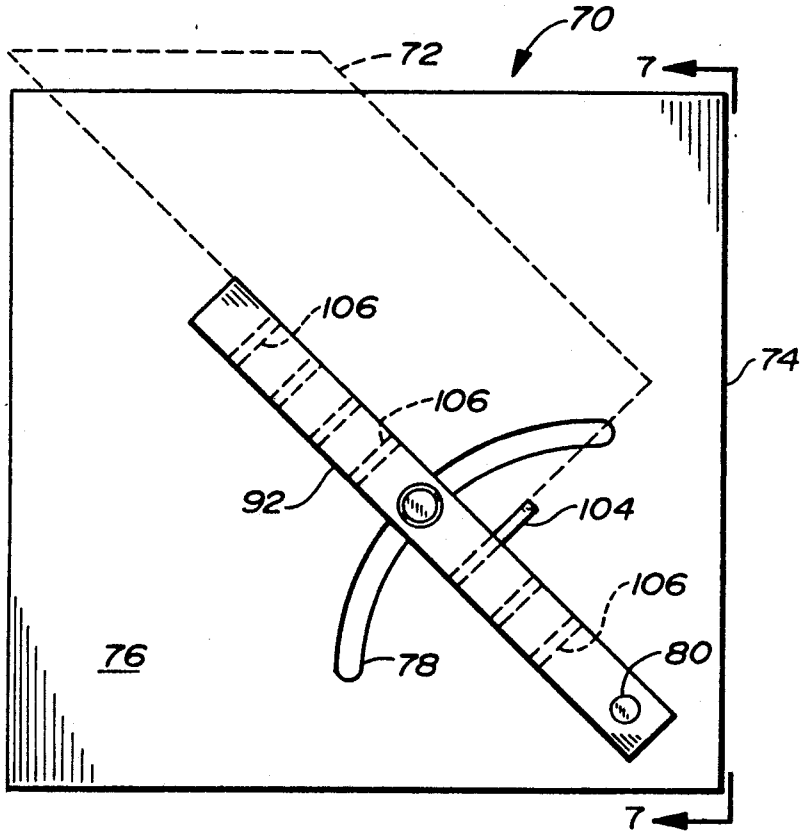
FIG. 6 is a front elevational view of a second embodiment of the tool of the present invention showing a work piece mounted thereon in a position to be drilled by a drill press.

A second embodiment of the tool of the present invention is broadly denoted by the numeral 70 and is shown in FIGS. 6 and 7. Tool 70 can be used for any number of different purposes but, for purposes of illustration, it is especially adapted for use with a drill press when it is desired to drill one or more holes into a work piece 72 (FIG. 6).

Tool 70 includes a first, generally upright plate 74 having a front face 76 provided with a curved slot 78 therethrough. The slot has an upper end and a lower end and the arcuate length of the slot is typically about 90° and the arc is a circular segment whose center is coincident with the central axis of a pin 80 which mounts an arm 92 on plate 74. The slot 78 has a relatively wide part and a relatively narrow part communicating with the wide part in the manner described above with respect to slot 46. A machine screw 94 extends through the narrow part and into the wide part, the screw having a head 96 in a recess in the arm 92. A spud or nut 98 (FIG. 7) is threaded onto screw 94 and is located in the widest part of the slot 78. The nut has an eccentric hole to allow the nut to engage the inner surface defining the slot to avoid having to place a tool or socket wrench over the nut to prevent it from turning as screw 94 is rotated.

Plate 74 is rigid to or integral with a normally horizontal plate 100 having a lower flat surface adapted to be mounted on a support surface 102 therebelow. The support surface typically is the tool mount of the drill press or other machine, whereby a work piece 72 can be mounted on the arm 92 and clamped such as by a C-clamp to plate 74 so as to be in a fixed position for being drilled or machined in some other fashion.

In use, tool 70 is mounted on surface 102 such as a table for a drill press and the work piece 72 is mounted on one side of arm 92 in the manner shown in FIG. 6 to provide a support for the work piece. The work piece can then be secured by a C-clamp or the like to plate 74, whereupon drilling of the work piece can then commence when the tool is placed beneath the drill of the drill press. The drilling of the work piece can commence and continue to completion or until the work piece is required to be oriented in a different position relative to the upper edge of plate 74.

The fact that arm 92 can be rotated and held in position by nut 98 allows for infinite variations in the operative position of arm 92 within the arcuate distance or span of curved slots 78. This arcuate distance can be increased or decreased as desired so that the slot need not be limited to a 90° arcuate distance. Moreover, the length of arm 92 can be increased by replacing it with a longer arm.

After machining, the C-clamp or other means is separated from plate 74 and the work piece is allowed to be removed for further machining elsewhere. The arm 92 can then be moved into another operative position depending upon the desired orientation of the work piece thereafter to be drilled.

Figure 8:
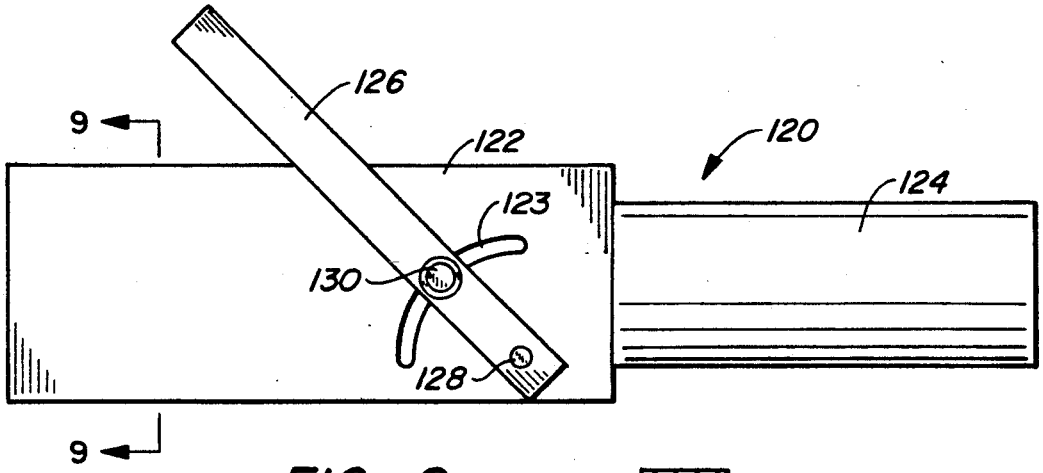
FIG. 8 is a side elevational view of a third embodiment of the tool of the present invention as adapted for orienting a compound of a lathe.
Figure 9:
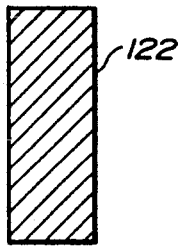
FIG. 9 is a cross sectional view taken along line 9—9 of FIG. 8.

Still another embodiment of the present invention is a tool 120 (FIG. 8) which is comprised of a bar 122 having a rectangular cross section (FIG. 9) and a slot 123 therethrough, the slot being curved and having a wide part and a narrow part as described above with respect to slots 46 and 78. A cylindrical member 124 is rigid to one end of bar 122 and extends outwardly therefrom. Member 124 is adapted to be removably coupled to the chuck of a lathe so as to orient an arm 126 on bar 122 at a location for aligning the compound of the lathe.

Arm 126 is pivotally mounted by a pin 128 to bar 122 with the pin being at the center of curvature of slot 123. The arm has a head 130 on a screw (not shown) which extends through slot 123. A spud or nut such as nut 98 (FIG. 7) is threaded onto the end of the screw and bears against the bar 122 within the widest part of the slot so as to releasably lock arm 126 in any one of a number of operative positions.

In use, member 124 is inserted into the chuck of a lathe. Then, arm 126 will be oriented in a desired operative position. This position will be used to align the compound of the lathe so as to mount a work piece on the lathe for subsequent machining.

Figure 10:
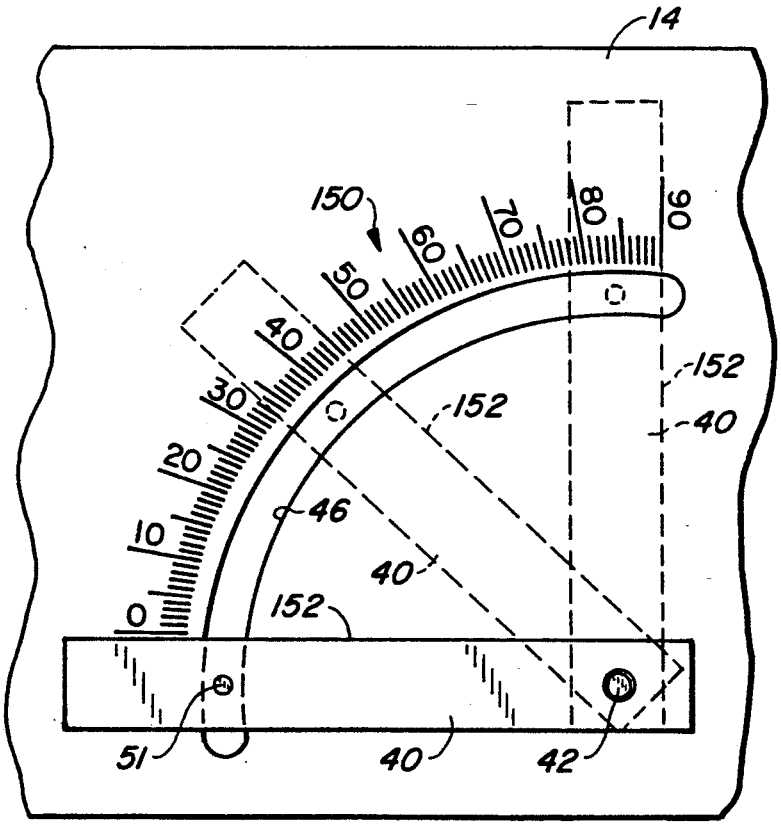
FIG. 10 is an enlarged, fragmentary front elevational view showing the alignment tool with an improved scale thereon.

In FIG. 10, an improved scale is shown, the scale being suitable for use on any one of the three embodiments described above. For purposes of illustration, the scale is shown on the first embodiment on central part 14 adjacent to and extending along slot 46. Arm 40 is pivotally mounted by pin 42 on central part 14 for rotation into any one of a number of operative positions. The full line position of arm 40 is at the zero (0) location on the scale. Two other locations of arm 40 are shown in FIG. 10, namely the 45° position and the 90° position.

The scale, broadly denoted by the numeral 150, is a 90° scale and the graduation lines of the scale are outwardly extending from slot 46 as shown in FIG. 10. The orientation of the graduation lines of scale 150 is such that the marginal edge 152 of arm 40 immediately adjacent to the front face of central part 14 extends flush with and coextensive with a particular graduation line of scale 150. For instance, in the full line position of arm 40, marginal edge 152 is coextensive with the zero graduation line of the scale. The intermediate dashed line position of arm 40 has marginal edge 152 of arm 40 coextensive with the 45° graduation line. The vertical location of arm 40 in FIG. 10 has the marginal edge 152 coextensive with the graduation line for the 90° graduation line. Regardless of the location or operative position of arm 40 relative to scale 150, marginal edge 152 will generally always be coextensive with a graduation line although it is possible that marginal edge 152 could be between a pair of adjacent graduation lines. In this way, the user of the tool can easily and readily adjust arm 40 to a particular angle relative to central part 14.

Scale 150 is formed by etching or otherwise on the front face of central part 14.

I claim:

1. A tool for aligning a work piece between a pair of relatively shiftable jaws of a machine vise comprising:

a body having a flat surface, said body including means for securing said body to said vise adjacent to one of the jaws thereof, said body having a curved slot formed into the surface thereof;

an elongated arm pivotally mounted on said body and juxtaposed with the surface of said body for movement in a plane parallel to the surface of said body past the slot formed therein to be disposed into any one of an unlimited number of operative positions along the slot, said arm having a work piece supporting surface adapted for engaging, supporting and orienting a work piece between and relative to the jaws of said vise, said arm including a plurality of holes formed thereinto at various locations spaced along the length of said arm, each of the holes having its axis aligned obliquely to all planes perpendicular to the surface of said body;

means extending into the slot formed in the surface of said body for releasably securing said arm in any one of the unlimited number of operative positions along the slot into which said arm may be disposed; and at least one pin removably inserted into any one of the holes in said arm, upon insertion into the hole said pin being adapted for engaging and supporting a work piece resting upon said arm when said arm is disposed in any one of the unlimited number of operative positions along the slot.

2. The tool of claim 1 further comprising means for defining a curved scale on the flat face of said body, said scale defining means having graduation lines disposed along and adjacent to the slot, said arm having a marginal edge alignable with and capable of being positioned coextensive with any one of the graduation lines when said arm is disposed in a selected one of the arm's operative positions along the slot.

3. The tool of claim 2, wherein said marginal edge of said arm is at one edge of said work piece supporting surface thereof.

4. The tool of claim 1, wherein the holes are free of threads, the pin being slidably insertable in a hole.

5. The tool of claim 1, wherein the holes are threaded, the pin being threadably insertable in a hole.

6. The tool of claim 1, wherein the arm has a second surface opposed to the work piece supporting surface, the tool capable of being inverted to permit either surface of said arm to engage, support and orient a work piece.

7. The tool of claim 6, wherein the holes extend through the arm.

8. The tool of claim 6, wherein the holes are free of threads, the pin being slidably insertable in the hole.

9. The tool of claim 6 wherein the holes are threaded, the pin being threadably insertable in a hole.

10. The tool of claim 6 wherein the holes are blind holes.

11. The tool of claim 2, wherein said work piece supporting surface is flat and has an edge adjacent to the body for defining said marginal edge.

12. A tool for aligning a work piece to be machined comprising:

a body having a flat surface and a reference, said body having a curved slot formed into the surface thereof;

an elongated arm pivotally mounted on said body and juxtaposed with the surface of said body for movement in a plane parallel to the surface said body past the slot formed therein to be thus disposed into any one of an unlimited number of operative positions along the slot, said arm having a work piece supporting surface adapted for engaging, supporting and orienting a work piece relative to the reference on said body, said arm including a plurality of holes formed thereinto at various locations spaced along the length of said arm, each of the holes having its axis aligned obliquely to all planes perpendicular to the surface of said body;

means extending into the slot formed in the surface of said body for releasably securing said arm in any one of the unlimited number of operative positions into which said arm may be disposed along the slot; and at least one pin removably inserted into any one of the holes in said arm, upon insertion into the hole said pin being adapted for engaging and supporting a work piece resting upon said arm when said arm is disposed in any one of the unlimited number of operative positions along the slot.

13. The tool of claim 12, wherein the holes are free of threads, the pin being slidably insertable in a hole.

14. The tool of claim 12, wherein the holes are threaded, the pin being threadably insertable in a hole.

15. The tool of claim 12 further comprising means for defining a curved scale on the flat surface of said body, said scale defining means having spaced graduation lines disposed along and adjacent to the slot, said arm having a marginal edge alignable with and capable of being positioned coextensive with any one of the graduation lines when said arm is disposed in a selected one of the arm's operative positions along the slot.

16. The tool of claim 15, wherein said marginal edge of said arm is at one edge of said work piece supporting surface thereof.

17. The tool of claim 15, wherein said work piece supporting surface is flat and has an edge adjacent to the body for defining said marginal edge.

* * * * *